US011017617B2

(12) United States Patent
Boss et al.

(10) Patent No.: US 11,017,617 B2
(45) Date of Patent: May 25, 2021

(54) PREDICTING VEHICULAR FAILURES USING AUTONOMOUS COLLABORATIVE COMPARISONS TO DETECT ANOMALIES

(71) Applicant: INTERNATIONAL BUSINESS MACHINES CORPORATION, Armonk, NY (US)

(72) Inventors: Gregory J. Boss, Saginaw, MI (US); Andrew R. Jones, Round Rock, TX (US); Charles S. Lingafelt, Durham, NC (US); Kevin C. McConnell, Austin, TX (US); John E. Moore, Jr., Pflugerville, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/732,731

(22) Filed: Jan. 2, 2020

(65) Prior Publication Data

US 2020/0143610 A1 May 7, 2020

Related U.S. Application Data

(60) Continuation of application No. 16/126,379, filed on Sep. 10, 2018, now Pat. No. 10,565,807, which is a (Continued)

(51) Int. Cl.
*G07C 5/08* (2006.01)
*G07C 5/00* (2006.01)

(52) U.S. Cl.
CPC ..... *G07C 5/0816* (2013.01); *G07C 5/008* (2013.01)

(58) Field of Classification Search
CPC ..... G07C 5/006; G07C 5/008; G07C 5/0808; G07C 5/0816; G07C 5/0841
See application file for complete search history.

(56) References Cited

U.S. PATENT DOCUMENTS 6,084,519 A 7/2000 Coulling et al.
6,759,963 B2 7/2004 Hayes
(Continued)

FOREIGN PATENT DOCUMENTS

CN 203455108 2/2014

OTHER PUBLICATIONS

Mell et al., "The NIST Definition of Cloud Computing", NIST, Special Publication 800-145, Sep. 2011, 7 pages.
(Continued)

*Primary Examiner* — Hongmin Fan
(74) *Attorney, Agent, or Firm* — William Hartwell; Andrew D. Wright; Roberts Calderon Safran & Cole. P.C.

(57) ABSTRACT

A computer-implemented method includes: determining, by a computer device, a value of an operating condition of a component of a vehicle; obtaining, by the computer device, a comparison value for the operating condition from one of: a same type component on the same vehicle; a same type component on at least one other vehicle; and a remote database; comparing, by the computer device, the determined value to the comparison value; determining, by the computer device and based on the comparing, whether the determined value deviates from the comparison value by more than a threshold amount; and generating an alert in the vehicle based on the determining the determined value deviates from the comparison value by more than the threshold amount.

15 Claims, 5 Drawing Sheets

Related U.S. Application Data division of application No. 15/333,586, filed on Oct. 25, 2016, now Pat. No. 10,109,120.

(56) References Cited

U.S. PATENT DOCUMENTS

| | | | | |
|---|---|---|---|---|
| 7,532,962 | B1 | 5/2009 | Lowrey et al. | |
| 8,085,706 | B2 | 12/2011 | Matsumoto | |
| 8,157,047 | B2 | 4/2012 | Breed | |
| 8,335,606 | B2 | 12/2012 | Mian et al. | |
| 8,412,107 | B2 | 4/2013 | Hamada et al. | |
| 9,580,028 | B2 | 2/2017 | Buck et al. | |
| 9,779,557 | B2 | 10/2017 | Hauser et al. | |
| 10,109,120 | B2 | 10/2018 | Boss et al. | |
| 10,643,403 | B2 * | 5/2020 | Madison | G07C 5/0808 |
| 2005/0194497 | A1 | 9/2005 | Matzan | |
| 2006/0149519 | A1 | 7/2006 | Keller | |
| 2010/0100275 | A1 | 4/2010 | Mian et al. | |
| 2014/0277902 | A1 | 9/2014 | Koch | |
| 2014/0288766 | A1 * | 9/2014 | Chakravarty | G05B 23/0235 701/32.4 |
| 2014/0379205 | A1 | 12/2014 | Muetzel et al. | |
| 2015/0105968 | A1 | 4/2015 | Ho | |
| 2015/0154816 | A1 | 6/2015 | Chen et al. | |
| 2015/0161830 | A1 | 6/2015 | Lenhardt et al. | |
| 2016/0093119 | A1 | 3/2016 | Ahn et al. | |
| 2016/0163133 | A1 * | 6/2016 | Ricci | G06K 9/00832 701/33.4 |
| 2017/0200325 | A1 * | 7/2017 | Kumar | G07C 5/085 |
| 2017/0213397 | A1 * | 7/2017 | Palmer | B60W 40/04 |
| 2017/0291615 | A1 | 10/2017 | Kusano et al. | |
| 2018/0018833 | A1 * | 1/2018 | Kannappa | G06F 16/22 |
| 2018/0114383 | A1 | 4/2018 | Boss et al. | |
| 2019/0005748 | A1 | 1/2019 | Boss et al. | |

OTHER PUBLICATIONS

List of IBM Patents or Patent Applications Treated as Related dated Jan. 2, 2020, 1 page.

* cited by examiner

PREDICTING VEHICULAR FAILURES USING AUTONOMOUS COLLABORATIVE COMPARISONS TO DETECT ANOMALIES

BACKGROUND

The present invention generally relates to vehicle condition monitoring and, more particularly, to predicting vehicular failures using autonomous collaborative comparisons to detect anomalies.

Vehicles and trailers today are not instrumented as much as they could be to give a driver awareness of problems before they become catastrophic failures. Travel being interrupted by a mechanical failure in a vehicle is an unfortunate and unpleasant experience and can result in injuries. This problem is especially significant in the insurance industry and the commercial fleet industry.

SUMMARY

In an aspect of the invention, a computer-implemented method includes: determining, by a computer device, a value of an operating condition of a component of a vehicle; obtaining, by the computer device, a comparison value for the operating condition from one of: a same type component on the same vehicle; a same type component on at least one other vehicle; and a remote database; comparing, by the computer device, the determined value to the comparison value; determining, by the computer device and based on the comparing, whether the determined value deviates from the comparison value by more than a threshold amount; and generating an alert in the vehicle based on the determining the determined value deviates from the comparison value by more than the threshold amount. In embodiments, the computer device is integrated in the vehicle.

The obtaining the comparison value may comprise detecting plural values of an operating condition of plural ones of the same type component on the same vehicle, wherein the comparison value is an average of the plural values of the operating condition. In this manner, implementations of the invention provide the advantage of comparing an operating condition of a component to other actual operating conditions of similar components on the same vehicle.

The obtaining the comparison value comprises receiving data from plural other vehicles, wherein the comparison value is an average of operating conditions from the plural other vehicles. In this manner, implementations of the invention provide the advantage of comparing an operating condition of a component to other actual operating conditions of similar components on other nearby vehicles.

The obtaining the comparison value may comprise sending a request to the database and receiving the comparison value from the database based on the request. The request may include a current location of the vehicle, and the comparison value may be based on the current location of the vehicle. In this manner, implementations of the invention provide the advantage of comparing an operating condition of a component to expert recommendations for a particular geographic location/area.

In an aspect of the invention, there is a computer program product that includes a computer readable storage medium having program instructions embodied therewith, the program instructions being executable by a computer device to cause the computer device to: determine a value of an operating condition of a component of a vehicle; obtain a comparison value for the operating condition from one of: a same type component on the same vehicle; a same type component on at least one other vehicle; and a remote database; determine the determined value deviates from the comparison value by more than a threshold amount; and generating an alert in the vehicle based on the determining the determined value deviates from the comparison value by more than the threshold amount.

In an aspect of the invention, a system includes: a CPU, a computer readable memory and a computer readable storage medium associated with a computer device; program instructions to determine, by the computer device, a value of an operating condition of a component of a vehicle; program instructions to obtain, by the computer device, a comparison value for the operating condition from one of: a same type component on the same vehicle; a same type component on at least one other vehicle; and a remote database; program instructions to determine, by the computer device, the determined value deviates from the comparison value by more than a threshold amount; and program instructions to generate, by the computer device, an alert in the vehicle based on the determining the determined value deviates from the comparison value by more than the threshold amount. The program instructions are stored on the computer readable storage medium for execution by the CPU via the computer readable memory.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

Figure 1:
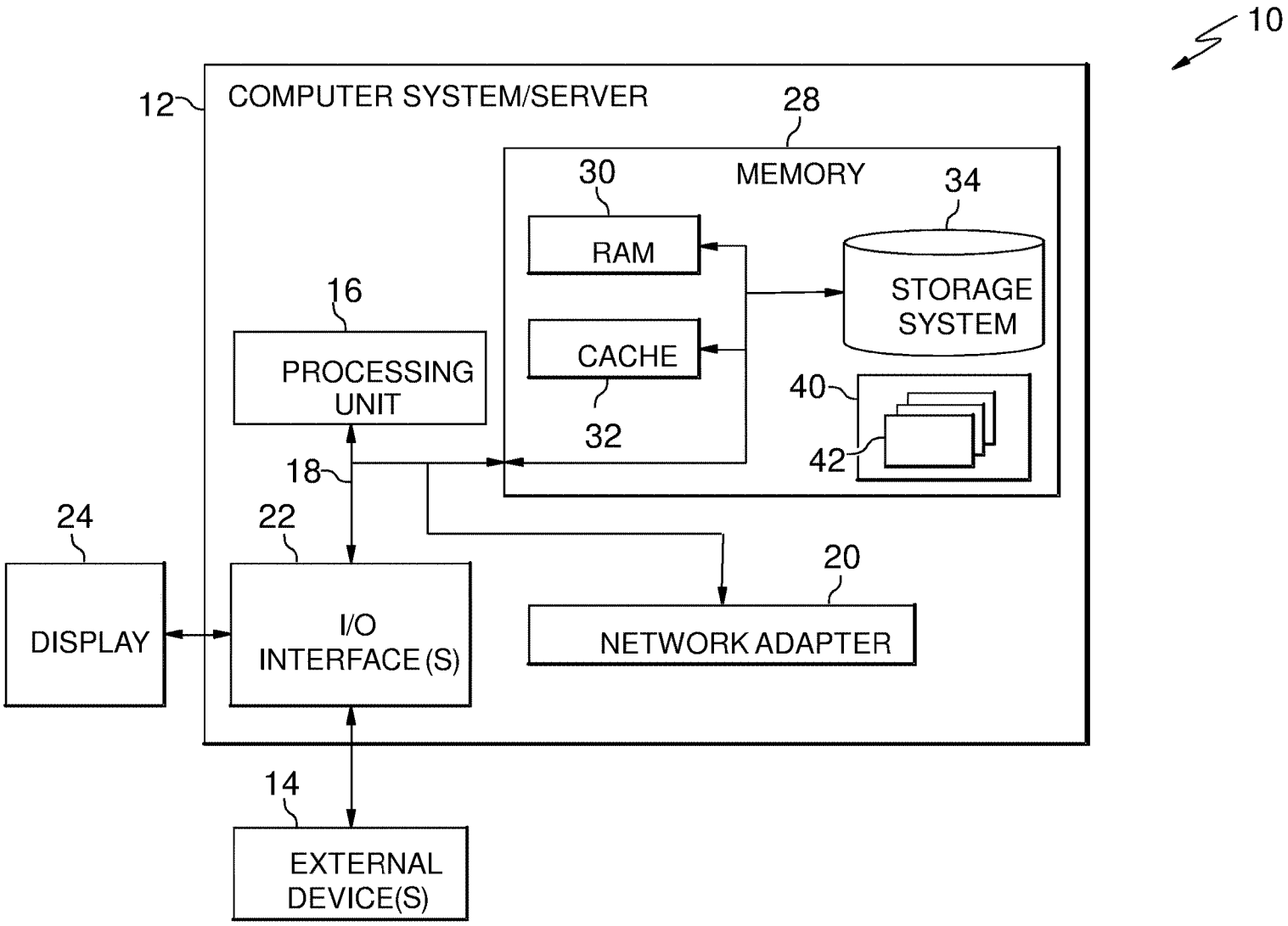
FIG. 1 depicts a cloud computing node according to an embodiment of the present invention.

The present invention generally relates to vehicle condition monitoring and, more particularly, to predicting vehicular failures using autonomous collaborative comparisons to detect anomalies. According to aspects of the invention, there is a vehicle monitoring system which compares two or more equivalent parts within a vehicle to each other in order to detect anomalies. The anomalies can still be within the manufacturer's normal operating thresholds, but through aspects of the invention will become an early warning system for drivers enabling them to avoid expensive repair work. In another embodiment, a vehicle autonomously communicates with other vehicles nearby to share component and system information in order to detect anomalies. In yet another embodiment, a vehicle compares measured conditions to recommendations provided by a network of expert advisors.

Implementations of the invention are useful in preventing costly vehicle repairs by predicting when a vehicle component may fail. A first embodiment compares one part of a vehicle to a same type part in another area of the same vehicle to determine anomalies. In this embodiment, a system measures operating characteristics of components of a vehicle that are identical (e.g. cylinders, brake rotors, shocks, wheel bearings, etc.), and compares the measured operating characteristics to each other. This embodiment is useable with any component where there is more than one of the component in the same vehicle. The system monitors for any anomalies in those measured characteristics and notifies the driver is an anomaly amongst components is detected.

A second embodiment involves a vehicle receiving data packets from other nearby vehicles and comparing its own measured operating characteristics of a component to values of corresponding components contained in the data packets received from other vehicles. This has the effect of comparing not only an identical part but also the environmental impacts of using that part in a given environment. Components will react differently in cold vs hot, humid vs dry, wet vs dry, environments. The second embodiment has the advantage of working with components to which there is only one that exists within a vehicle.

A third embodiment involves a vehicle comparing its measured operating characteristics of a component to values provided by a network of expert advisors. The third embodiment provides the advantage of utilizing geography-based expert knowledge regarding when maintenance or replacement of a component should be performed. The three embodiments may be used separately or may be combined in a single system to achieve an accurate result.

Implementations of the invention provide a technical solution that includes a vehicle-based computer system using at least one sensor to detect an operating condition of a component of a vehicle, and comparing that detected operating condition to one of: a detected operating condition of a same type of component on the same vehicle; a detected operating condition of s same type of component on another nearby vehicle; and a database of expert recommendations for that component.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is understood in advance that although this disclosure includes a detailed description on cloud computing, implementations of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a nonremovable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
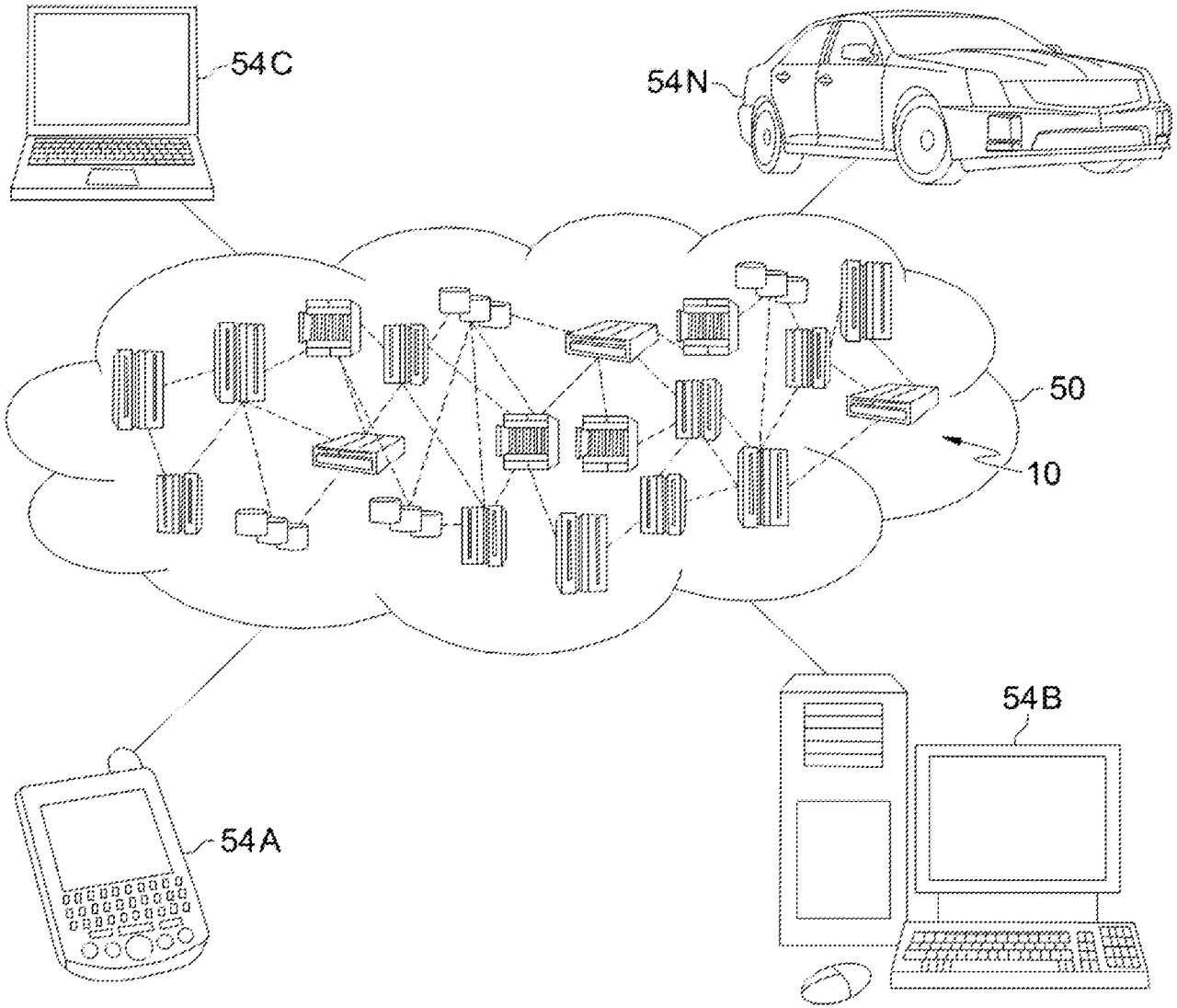
FIG. 2 depicts a cloud computing environment according to an embodiment of the present invention.

Referring now to FIG. 2, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
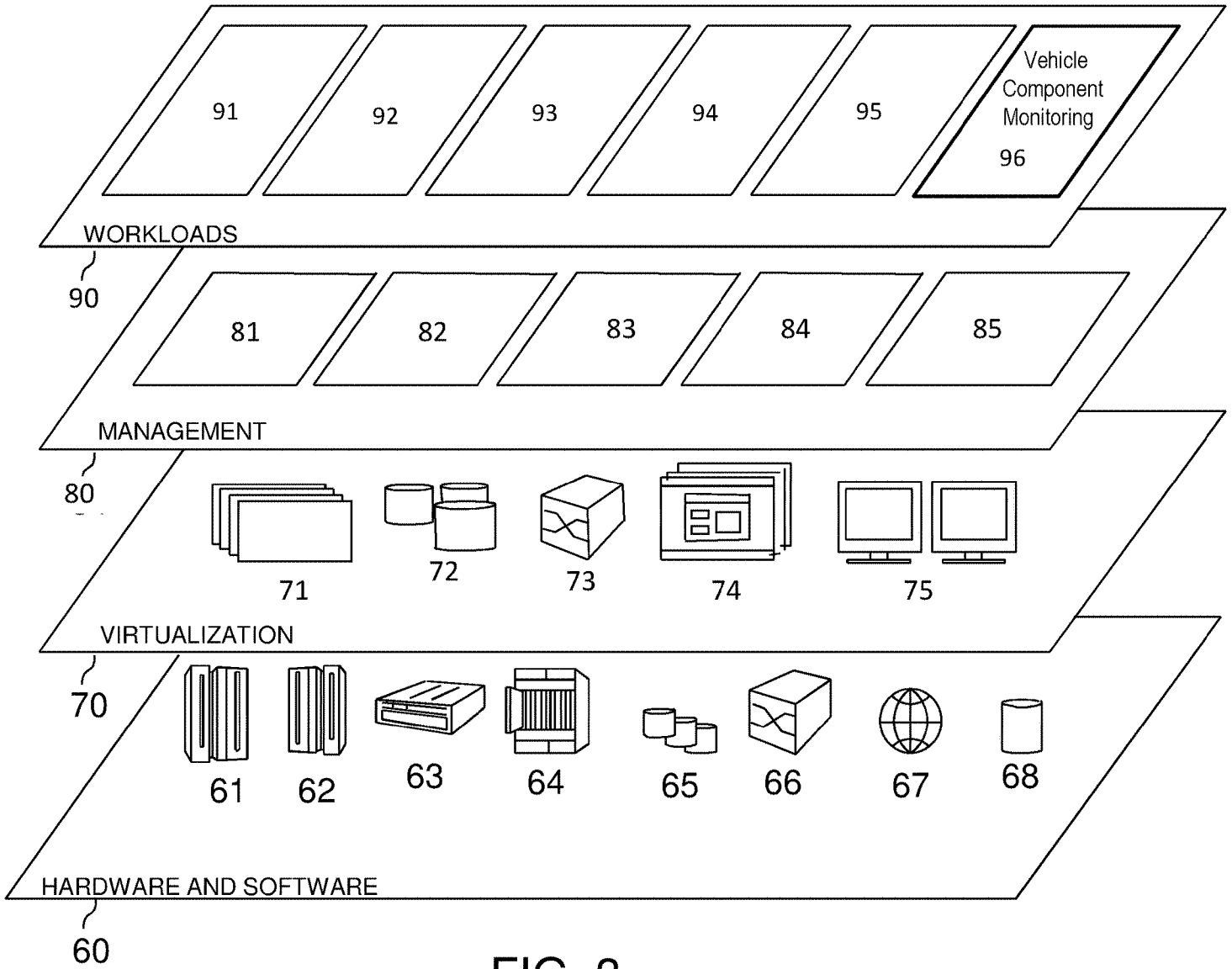
FIG. 3 depicts abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and vehicle component monitoring 96.

Referring back to FIG. 1, the program/utility 40 may include one or more program modules 42 that generally carry out the functions and/or methodologies of embodiments of the invention as described herein, such as the functionally of vehicle component monitoring 96 of FIG. 3. Specifically, the program modules 42 may receive user information, generate a service list based on the user information, and display user information and selected services for service provider personnel. Other functionalities of the program modules 42 are described further herein such that the program modules 42 are not limited to the functions described above. Moreover, it is noted that some of the modules 42 can be implemented within the infrastructure shown in FIGS. 1-3. For example, the modules 42 may be implemented in the environment shown in FIG. 4.

Figure 4:
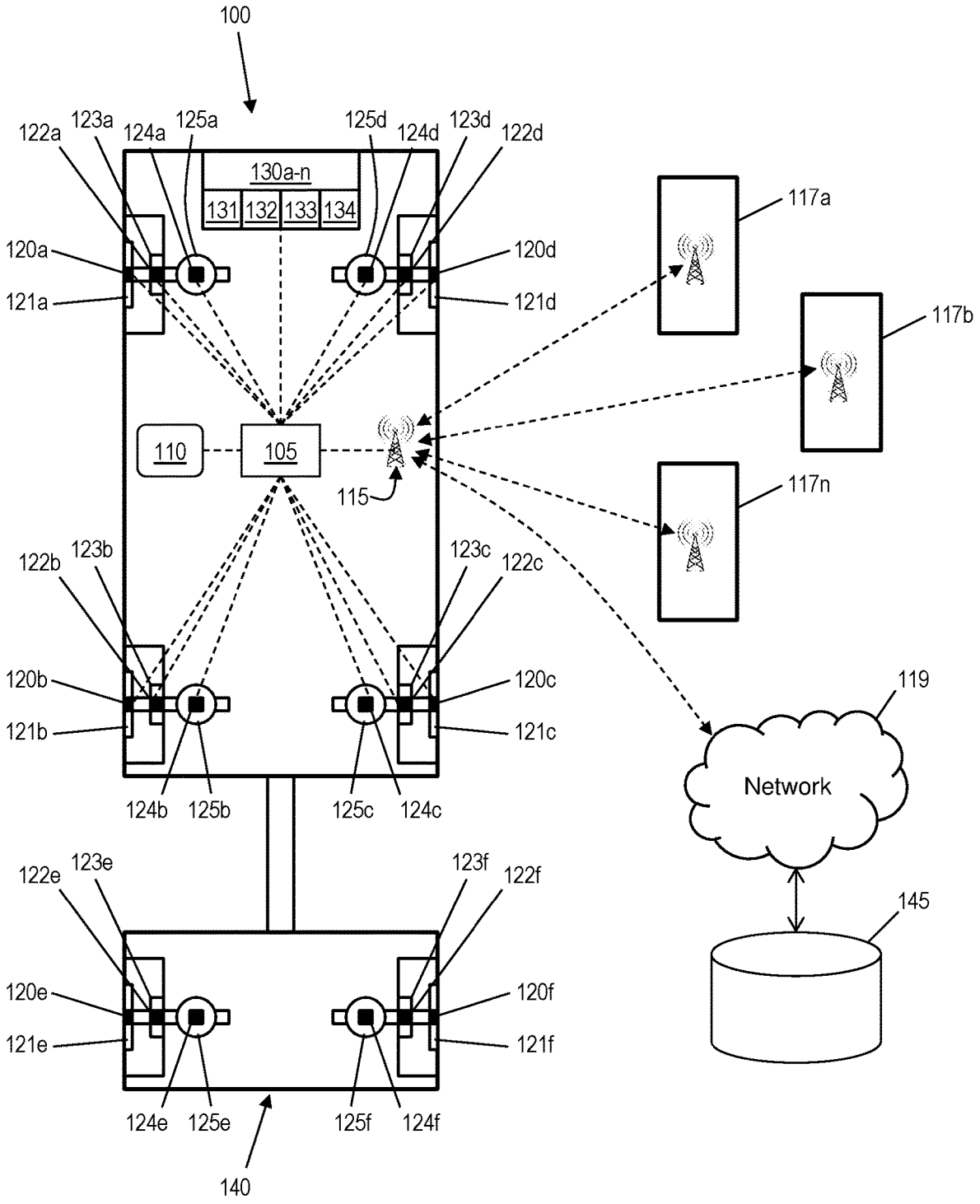
FIG. 4 shows an exemplary environment in accordance with aspects of the present invention.

FIG. 4 shows an environment in accordance with aspects of the invention. The environment includes a vehicle 100 which may be any suitable motor vehicle including but not limited to a car, truck, or motorcycle. The vehicle 100 includes an on-board computer 105, which may include one or more components of computer system 12 of FIG. 1, such as a processor, a memory, and one or more program modules that perform functions of aspects of the invention. In embodiments, the vehicle 100 includes a display 110 that is operatively connected to the computer 105. The display 110 may comprise, for example, a touch screen LCD that is configured to display a user interface and receive input from a user (e.g., a driver or passenger in the vehicle 100). The vehicle 100 also includes an antenna 115 operatively connected to the computer 105. The antenna 115 is configured for radio communication between the vehicle 100 other vehicles 117*a-n*, and for radio communication between the vehicle 100 and a network 119 that is external to the vehicle 100. The antenna 115 may comprise a single antenna or plural antennae, and may be configured for any suitable radio communication protocol including but not limited to at least one of Bluetooth, WiFi, and cellular.

According to aspects of the invention, the computer 105 is operatively connected to sensors that detect operating conditions of components of the vehicle 100. For example, the computer 105 may be operatively connected to temperature sensors 120*a-f* that detect the temperature of respective brake rotors 121*a-f* connected to wheels of the vehicle 100. The computer 105 may be operatively connected to temperature sensors 122*a-f* that detect the temperature of respective wheel bearings 123*a-f* connected to wheels of the vehicle 100. The computer 105 may be operatively connected to displacement sensors 124*a-f* that detect the travel distance of struts 125*a-f* connected to axles of the vehicle 100. The computer 105 may be operatively connected to temperature sensors 130*a-f* that detects the temperature of respective cylinders in an engine of the vehicle 100. The computer 105 may be operatively connected to one or more of: a temperature sensor 131 that detects an engine oil temperature of the vehicle 100; a pressure sensor 132 that detects an engine oil pressure of the vehicle 100; a temperature sensor 133 that detects an coolant temperature of the vehicle 100; and a temperature sensor 134 that detects an transmission oil/fluid temperature of the vehicle 100.

Implementations of the invention are not limited to the aforementioned types of sensors and vehicle components, and instead any suitable sensors can be used with any desired components on the vehicle to measure component operating conditions such as temperature, flex, rotation, speed, vibration, fluid level, and pressure. Moreover, the sensors and components may be located on the vehicle 100, on a trailer 140 pulled by the vehicle 100, or both.

With continued reference to FIG. 4, in a first embodiment, the computer 105 monitors the data collected by sensors of a set of components on the vehicle 100 and provides a warning when one component of the set has a detected operating condition that deviates by more than a threshold amount from the operating condition of the other components of the set. The first embodiment includes a self-contained system within the vehicle 100 and compares detected operating conditions of components of which there are two or more of the same type of component in the vehicle 100. In accordance with aspects of the invention, rather than comparing a detected operating condition to a predefined manufacturer specified value for the operating condition, the system compares a detected operating condition of one component to a detected operating condition of one or more of the same type of component within the vehicle.

For example, the computer 105 may collect data from sensors 120*a-f* to compare the temperature of each one of the respective brake rotors 121*a-f* to the other ones of the brake rotors. Specifically, using the sensor data, the computer 105 may determine an average temperature of brake rotors 121*b-f*, and compare the temperature of brake rotor 121*a* to the determined average temperature of the other brake rotors 121*b-f*. The determined average temperature of the other components may be considered a comparison value. The computer 105 may use the comparing to determine whether the detected temperature of brake rotor 121*a* exceeds the determined average temperature of the other brake rotors 121*b-f* by a threshold amount. In one embodiment. the determined average value is based on an instantaneous value of the operating condition for each component. For example, the system may detect the temperature of each brake rotor at a single point in time, and compare the temperature of one of the brake rotors to an average temperature of the other brake rotors for this single point in time. In another embodiment, the determined average value is implemented using plural detected values of operating conditions over a rolling window of time with a predefined duration. For example, the system may detect and store the temperature of each brake rotor over the past twenty minutes of driving. The system may then determine an average value of the brake rotor temperature based on the twenty minutes worth of data (instead of based on a single data point at a single point in time). This embodiment provides the advantage of capturing variances of the environment. For example, a vehicle traveling into a harsh desert environment where there is no shade in one hundred degree weather will create a variance over twenty minutes that is significant. The predefined duration can be variable based on user preference, location, or detected conditions.

In the event the detected operating condition (e.g., temperature) of a single component exceeds the determined average operating condition (e.g., temperature) of the other ones of the same type of component by the threshold amount, then the computer 105 may generate an alert to the occupant(s) of the vehicle 100 (e.g., the driver). The alert may be audible or visual or both, and may be presented via one of more of: the display 110, an audio (speaker) system of the vehicle 100, and an instrument panel of the vehicle 100. Other types of indicators in the vehicle 100 may also be used to present the alert. In addition to, or alternatively to, generating an alert when the detected operating condition exceeds the comparison value by the threshold amount, the computer 105 may also cause an automated action in the vehicle. The automated action may include but is not limited to: automatically limiting the speed of the vehicle, and automatically altering a navigation system of the vehicle to direct the driver to a repair facility.

In one aspect, the threshold amount is a percent that defines a permissible percentage deviation of the operating condition of one component to the average operating condition of the other one of the same type of component. For example, the threshold may be set at a factory default value of 3%. In this manner, if the temperature of one brake rotor is more than 3% higher than the average temperature of the other brake rotors, then the computer 105 will generate the alert. In embodiments, the threshold amount may be based on input from an occupant of the vehicle 100 (e.g., the driver). For example, the threshold amount may be set at a factory default value (e.g., 3%) and the system may be configured to permit the driver to provide input (e.g., via an interface on the display 110) that changes the threshold amount to another value (e.g., 2% or 4%) that is different than the factory default value. In this manner, the driver may customize how sensitive the alert system operates in the vehicle 100.

The computer 105 may be configured to perform the comparison for each individual one of the components against the average value of the other ones of the components in the same vehicle. For example, the computer 105 may compare the temperature of brake rotor 121*a* to the average temperature of other brake rotors 121*b-f*. The computer 105 may also compare the temperature of brake rotor 121*b* to the average temperature of other brake rotors 121*a* and 121*c-f*. The computer 105 may also compare the temperature of brake rotor 121*c* to the average temperature of other brake rotors 121*a-b* and 121*d-f*, and so on until all of the individual components have been compared against a group of other ones of the same type of component. When an alert is generated based on an operating condition of a component exceeding the average value of the other same type of components, the alert may indicate which particular one of the components caused the alert, and how much the operating condition of the component exceeds the average value of the other same type of components (e.g. "the drive side front brake rotor has a temperature that is 5% higher than the other brake rotors").

The computer 105 may also be configured to log when an alert is generated. For example, when an alert is generated, the computer may store data (e.g., in memory) that defines parameters such as: time and date of the alert, identity of the component that caused the alert, operating condition of the component that caused the alert, and percent deviation of the operating condition of the component that caused the alert compared to the determined average operating condition of the other ones of the same type of component.

The first embodiment has been described with respect to the temperature of brake rotors 121*a-f* as detected by sensors 120*a-f*. Implementations of the invention are not limited to the temperature of brake rotors. Instead, any detected operating condition of any group of plural components may be used. The computer 105 may be configured to detect and compare operating conditions for plural different groups of components independently of each other. For example, the computer 105 may detect and compare temperatures of brake rotors 121*a-f*, and may separately detect and compare temperatures of wheel bearings 123*a-f*, and so on.

The detection and comparison of operating conditions as described herein may be performed at any desired time interval. For example, the detection and comparison of operating conditions may be performed every thirty seconds. In embodiments, the computer 105 may adjust this interval based on user input. For example, the system may be configured to permit the driver to provide input (e.g., via an interface on the display 110) that changes the time interval from a factory default value to a user-defined value. In this manner, the driver may customize how frequently the alert system operates in the vehicle 100.

Still referring to FIG. 4, in a second embodiment, the computer 105 receives data from other vehicles 117*a-n* regarding the operating conditions of components on the other vehicles 117*a-n*. The computer 105 monitors the data collected by sensors of components on the vehicle 100 and provides a warning (e.g., generates an alert) when a component on the vehicle 100 has a detected operating condition that deviates by more than a threshold amount from the operating condition the same or similar components of the other vehicles 117*a-n*. In aspects, this second embodiment is particularly useful for components for which there is only one of the component in a vehicle (e.g., transmission temperature of a single transmission), as opposed to components for which there are plural ones of a same type of component in a vehicle (e.g., brake rotor temperature of plural different brake rotors).

In accordance with aspects of the invention, vehicles 100, 117*a*, 117*b*, 117*n* equipped with the system transmit data packets to other vehicles. The data packet sent from one vehicle (e.g., vehicle 117*a*) may include data that defines: make of the vehicle 117*a*; model of the vehicle 117*a*; year of the vehicle 117*a*; environmental conditions of the vehicle 117*a*; road conditions of the vehicle 117*a*; type of detected operation condition; and value of the detected operation condition. The transmitting may be performed using a radio communication antenna (e.g., antenna 115) on each vehicle, and may be made using suitable short range communications protocols such as Bluetooth, WiFi, etc. The transmitting may be a broadcast (e.g., where a vehicle transmits a data packet to any other vehicle within range) or may be point to point (e.g., where a vehicle transmits a data packet to a single other vehicle). When point to point is used, the vehicle 100 may initially broadcast a request beacon, and other vehicles 117*a-n* receiving the request beacon may transmit a data packet solely to the vehicle 100. The request beacon may include data that defines a request for measured operating conditions of only specific components. In this manner, the requesting vehicle 100 is asking for specific data. In the broadcast method, on the other hand, the transmitting vehicles may send out data packets containing all available data (e.g., for all measured operating conditions), in which case it is left to the receiving vehicle to select which data to use.

The receiving vehicle (e.g., vehicle 100), upon receiving a data packet from another vehicle (e.g., vehicle 117*a*), may compare the value of the detected operation condition from the other vehicle (e.g., a comparison value) to the detected value of the same type of operating condition of the receiving vehicle. The detected value of the same type of operating condition received from another vehicle may be considered a comparison value. For example, the receiving vehicle 100 may receive a data packet from vehicle 117*a*, the data packet defining a transmission temperature of vehicle 117*a*. Upon receiving this data packet from vehicle 117*a*, the computer 105 in vehicle 100 may detect the transmission temperature of vehicle 100 (e.g., using sensor 134), and compare the detected transmission temperature of vehicle 100 to the received transmission temperature of vehicle 117*a*. In the event the detected operating condition of the receiving vehicle 100 exceeds the operating condition of the other vehicle 117*a* by a threshold amount (e.g., 3%), then the computer 105 of the receiving vehicle 100 generates an alert to the driver of the receiving vehicle 100. The alert may be generated in the same manner as described with respect to the first embodiment. The threshold amount may be adjusted in the manner described with respect to the first embodiment.

According to aspects of the invention, the receiving vehicle 100 may receive data packets from plural other vehicles 117*a-n*, where "n" is an integer greater than one. In this manner, the receiving vehicle 100 may compare its operating condition (e.g., transmission temperature of vehicle 100) to the same operating condition of plural other vehicles (e.g., respective transmission temperatures of vehicles 117*a-n*). The computer system of the receiving vehicle 100 may compare its detected operating condition to an average value of the same operating condition of the plural other vehicles. The average value of the same type of operating condition received from other vehicles may be considered a comparison value. The average value of the same operating condition of the other vehicles may be a weighted average based on a similarity ranking of each of the other vehicles to the receiving vehicle. The computer 105 of the receiving vehicle 100 may use data in the received data packets to rank the data received from the plural other vehicles 117*a-n*, e.g., based on similarity of the other vehicles 117*a-n* to the receiving vehicle 100.

For example, one or more of the make, model, year, environmental conditions, and road conditions data contained in the data packets from the other vehicles 117*a-n* may be used by the computer to determine a relative level of similarity of the receiving vehicle 100 to each of the other vehicles 117*a-n*. For example, a vehicle 117*a* that has the same make, model, and year as the vehicle 100 may be deemed more similar to the vehicle 100 than another vehicle 117*b* that has the same make and model but a different year than vehicle 100. The determined relative levels of similarity may be used to rank the operating conditions of the other vehicles when determining a weighted average of the other vehicles. For example, the transmission temperature of vehicle 117*a* may be ranked higher (and given a higher weight in the weighted average) than the transmission temperature of vehicle 117*b* because vehicle 117*a* is more similar to vehicle 100 than is vehicle 117*b*.

The data packet broadcast from another vehicle may include plural values of the detected operating condition detected in the other vehicle at different times. For example, the data packet may include ten data points defining the ten measurements of transmission temperature of the other vehicle 117*a* detected over the previous five minutes. In this manner, each data point from a vehicle may be ranked (e.g., based on one or more of the make, model, year, environmental conditions, and road conditions data contained in the data packets), and plural ranked data points from plural different vehicles 117*a-n* may be used to create the weighted average value that is compared to the detected operating condition of the receiving vehicle 100. The user of time-based data points is particularly useful in accounting for environmental conditions (e.g., outside temperature, rain, etc.) and road conditions (smooth, bumpy, uphill, etc.) that may change over time.

The data contained in the data packets received from other vehicles 117*a-n* (e.g., make; model; year; environmental conditions; road conditions) may be used to filter certain ones of the vehicles from the comparison to the receiving vehicle 100. As one example, the computer 105 may be programmed to automatically eliminate data from any vehicle that is not the same make as the receiving vehicle. Implementations are not limited to this example, and any desired filtering may be performed using any one or more of the make, model, year, environmental conditions, and road conditions. The value of the measured operating condition of a vehicle that is eliminated by such filtering is not used in determining the average value of operating condition that is compared to the detected operating condition of the receiving vehicle. For example, if vehicle 117*a* is eliminated by filtering, then the value of the transmission temperature of vehicle 117*a* is not used when determining the average transmission temperature of other vehicles 117*b-n* to compare to the transmission temperature of receiving vehicle 100.

With continued reference to FIG. 4, in a third embodiment, the computer 105 receives data from a database 145 via a network 119, wherein the database data defines ranges of operating conditions of components. The computer 105 monitors the data collected by sensors of components on the vehicle 100 and provides a warning (e.g., generates an alert) when a component on the vehicle 100 has a detected operating condition that is outside a range of operating conditions defined by the database data (e.g., a comparison value).

In this embodiment, the vehicle 100 communicates with a cloud based network advisor of parts recommendations for vehicles in a particular geographic area/location. According to aspects of the invention, the database 145 is populated with data entries that define at least one of: geographic area/location; make; model; year; component; and range of operating condition values for the component. The database entries are created by experts (e.g., mechanics) in the respective geographic areas/locations. For example, an expert in Phoenix may submit a database entry that defines a range of acceptable coolant temperatures for a particular make, model, and year of vehicle operating in the Phoenix area. Similarly, another expert in Anchorage may submit a database entry that defines a range of acceptable coolant temperatures for a particular make, model, and year of vehicle operating in the Anchorage area. The range of acceptable coolant temperatures may differ in the Phoenix compared to Anchorage. In another example, an expert in Tucson may submit a database entry that indicates a main radiator hose should be replaced after five years for a particular make, model, and year of vehicle operating in the Tucson area. Similarly, another expert in Seattle may submit a database entry that indicates a main radiator hose should be replaced after ten years for a particular make, model, and year of vehicle operating in the Seattle area.

According to aspects of the invention, the vehicle 100 transmits its make, model, year, and current geographic area/location to the database 145 via the network 119. The current geographic area/location of the vehicle 100 may be determined by the computer 105 using GPS (global positioning system), for example. An advisor (e.g., a software program module) at the database 145 retrieves recommendation data from the database 145 that matches the make, model, year, and current geographic area/location of the vehicle 100. The recommendation data may include, for example, ranges of acceptable operating conditions for components (e.g., a range of acceptable coolant temperatures) and parts recommendations (e.g., main radiator hose should be replaced after 'X' years). The advisor sends the recommendation data to the vehicle 100 via the network 119, and the vehicle 100 compares the recommendation data to detected operating conditions of components in the vehicle 100. For example, the vehicle 100 may compare the detected coolant temperature (detected using sensor 133) to the range of acceptable coolant temperatures (received from the database 145), and may generate an alert if the detected coolant temperature is outside of the range of acceptable coolant temperatures by more than a threshold amount. The alert may be generated in the same manner as described with respect to the first embodiment. The threshold amount may be adjusted in the manner described with respect to the first embodiment.

Figure 5:
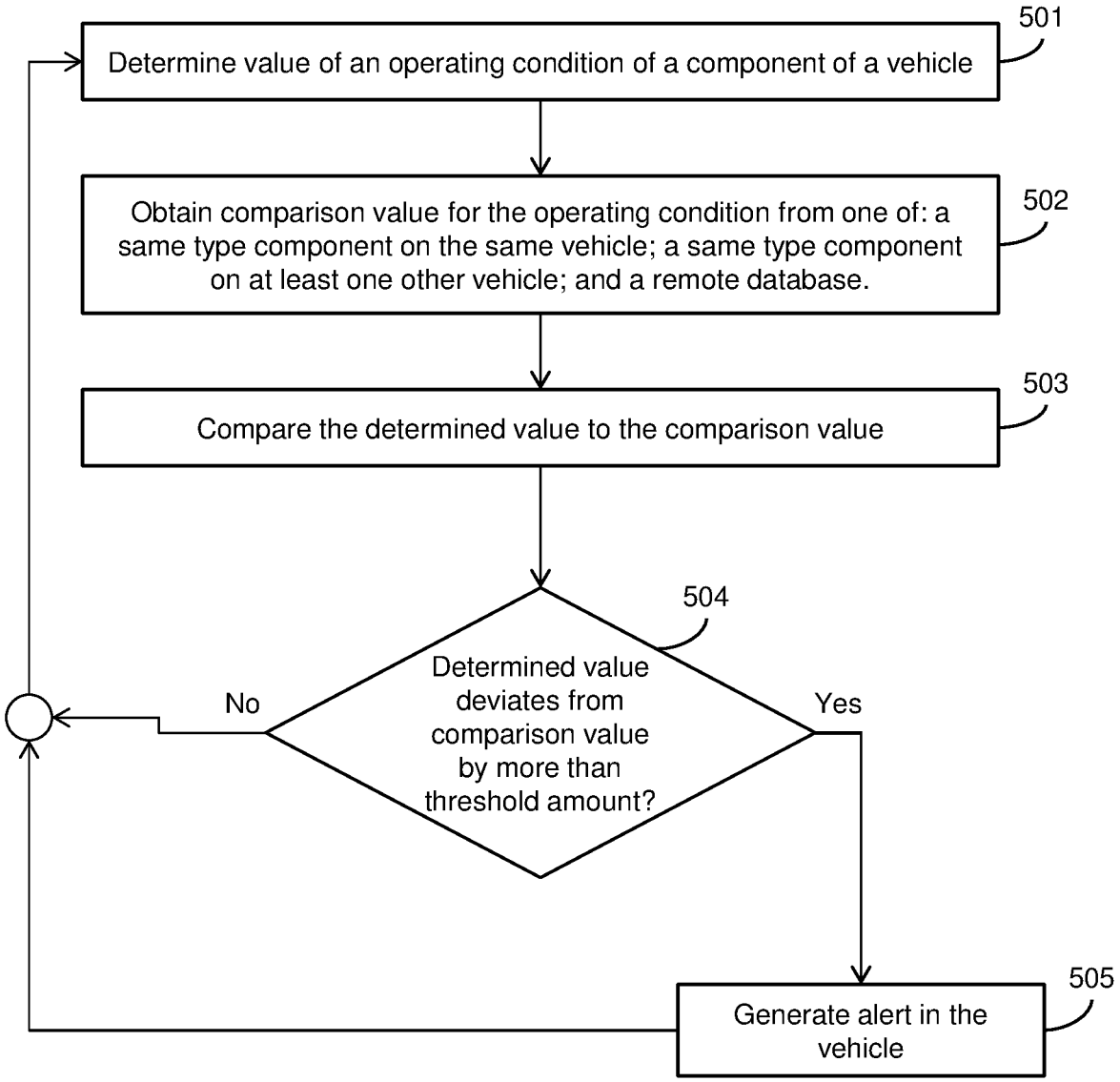
FIG. 5 shows a flowchart of an exemplary method in accordance with aspects of the present invention.

FIG. 5 shows a flowchart of an exemplary method in accordance with aspects of the present invention. The steps of FIG. 5 may be implemented in the environment of FIG. 4, for example, and are described using reference numbers of elements depicted in FIG. 4. As noted above, the flowchart illustrates the architecture, functionality, and operation of possible implementations of systems, methods, and computer program products according to various embodiments of the present invention.

At step 501, the system (e.g., computer 105) determines a value of an operating condition of a component of a vehicle 100. Step 501 may be performed in the manner described with respect to FIG. 4, e.g., using any desired number of any desired type of sensors (e.g., sensors 120*a-f*, 122*a-f*, 124*a-f*, 130*a-n*, 131, 132, 133, 134) associated with various components of the vehicle 100. The operating condition may be any desired operating condition including but not limited to: temperature, flex, rotation, speed, vibration, fluid level, and pressure. The component may be any desired component including but not limited to: brake rotors, wheel bearings, struts, transmission, engine cylinders, and engine oil.

At step 502, the system obtains a comparison value for the operating condition from one of: a same type component on the same vehicle; a same type component on at least one other vehicle; and a remote database. As described with respect to the first embodiment with FIG. 4, the comparison value may be based on a detected operating condition of one or more of the same type of component on the same vehicle 100. For example, the computer 105 may compare the temperature of one brake rotor on the vehicle 100 to an average temperature of plural other brake rotors on the vehicle 100. Alternatively, as described with respect to the second embodiment with FIG. 4, the comparison value may be based on an operating condition of the same type of component from at least one other vehicle 117*a-n*. For example, the vehicle 100 may compare the transmission temperature of the vehicle 100 to the transmission temperature of one or more other vehicle 117*a-n*. When plural other vehicles are used, the comparison value may be an average value, and preferably a weighted average as described with respect to FIG. 4. Alternatively, as described with respect to the third embodiment with FIG. 4, the comparison value may be based on data from a database 145 that is remote from the vehicle 100. For example, the vehicle 100 may compare the transmission temperature of the vehicle 100 to a range of transmission temperatures received from the database 145 via a network 119.

At step 503, the system compares the determined value (from step 501) to the comparison value (from step 503). At step 504, based on the comparing, the system determines whether the determined value deviates from the comparison value by more than a threshold amount. As described with respect to FIG. 4, the threshold amount may be a percentage value, which may have a default setting and which may be adjusted by the operator of the vehicle 100.

In the event the determined value does not deviate from the comparison value by more than the threshold amount at step 504, then the process returns to step 501 where the system measures another value of an operating condition of the same component or a different component.

In the event the determined value deviates from the comparison value by more than the threshold amount at step 504, then at step 505 the system generates an alert. The alert may be generated in the manner described with respect to FIG. 4, e.g., via one of more of: the display 110, an audio (speaker) system of the vehicle 100, and an instrument panel of the vehicle 100. Step 505 may also include logging the event. Following step 505, the process returns to step 501 where the system measures another value of an operating condition of the same component or a different component.

According to aspects described herein, there is a method of identifying a pending failure in a vehicle, the method comprising the steps of: providing measurements of a mechanical part of a vehicle; comparing said measurements to corresponding measurements made on identical parts in said vehicle; comparing said measurements to measurements made on identical parts in nearby vehicles; comparing said measurements to corresponding crowdsourced recommendations of vehicle owners located nearby geographically; and alerting a driver of said vehicle when any said comparing shows a statistically significant deviation. The method may additionally or alternatively include causing an automated change of one or more vehicle functions (e.g., limited top speed, etc.) when any said comparing shows a statistically significant deviation, i.e., to mitigate the detected condition. This method has the advantage in that it will detect a potential problem before the problem exceeds the manufacturer's specification. This would allow an operator to avoid costly repairs or a potential accident. Further, aspects of the invention will identify a potential problem before it causes failure (e.g., vehicle breakdown) even if both parts are at the same measurement within manufacturers specifications or replaced based on a social network of input for vehicles in a geographic location.

In embodiments, a service provider, such as a Solution Integrator, could offer to perform the processes described herein. In this case, the service provider can create, maintain, deploy, support, etc., the computer infrastructure that performs the process steps of the invention for one or more customers. These customers may be, for example, any business that uses technology. In return, the service provider can receive payment from the customer(s) under a subscription and/or fee agreement and/or the service provider can receive payment from the sale of advertising content to one or more third parties.

In still additional embodiments, the invention provides a computer-implemented method, via a network. In this case, a computer infrastructure, such as computer system/server 12 (FIG. 1), can be provided and one or more systems for performing the processes of the invention can be obtained (e.g., created, purchased, used, modified, etc.) and deployed to the computer infrastructure. To this extent, the deployment of a system can comprise one or more of: (1) installing program code on a computing device, such as computer system/server 12 (as shown in FIG. 1), from a computer-readable medium; (2) adding one or more computing devices to the computer infrastructure; and (3) incorporating and/or modifying one or more existing systems of the computer infrastructure to enable the computer infrastructure to perform the processes of the invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer program product comprising a computer readable storage medium having program instructions embodied therewith, the program instructions executable by a user computer to cause the computer device to:

determine, based on data from a sensor on a vehicle, a value of an operating condition of a component of the vehicle;

obtain, via network communication from a database external to the vehicle, a comparison value for the operating condition of the component;

determine the determined value based on the data from the first sensor deviates from the comparison value by more than a threshold amount; and generate an alert in the vehicle based on the determining the determined value deviates from the comparison value by more than the threshold amount.

2. The computer program product of claim 1, wherein the obtaining the comparison value comprises:

transmitting a current location of the vehicle to the database via the network; and in response to the transmitting, receiving the comparison value, wherein the comparison value defines a range of operating conditions for the component of the vehicle for the current location of the vehicle.

3. The computer program product of claim 1, wherein the obtaining the comparison value comprises:

transmitting a make of the vehicle, a model of the vehicle, a year of the vehicle, and a current location of the vehicle to the database via the network; and in response to the transmitting, receiving the comparison value, wherein the comparison value defines a range of operating conditions for the component of the vehicle for the make, model, year, and current location of the vehicle.

4. The computer program product of claim 1, wherein, based on the determining the determined value deviates from the comparison value by more than the threshold amount, the program instructions cause the computer device to automatically limit a speed of the vehicle.

5. The computer program product of claim 1, wherein, based on the determining the determined value deviates from the comparison value by more than the threshold amount, the program instructions cause the computer device to automatically alter a navigation system of the vehicle to direct a driver of the vehicle to a repair facility.

6. The computer program product of claim 1, wherein:

the determining the determined value and the obtaining the comparison value are repeated at a defined time interval; and the computer device is configured to receive input from a user via an interface in the vehicle, and to change the defined time interval based on the input.

7. The computer program product of claim 1, wherein the computer device is configured to receive input from a user via an interface in the vehicle, and to adjust the threshold amount based on the input.

8. The computer program product of claim 1, wherein the threshold amount is initially set at a factory default value and the input from the user changes the threshold amount from the factory default value to another value that is different than the factory default value.

9. The computer program product of claim 1, wherein:

the determining the value of the operating condition comprises determining a temperature of a brake rotor of the vehicle; and the obtaining the comparison value for the operating condition comprises: transmitting a current location of the vehicle to the database via the network; and in response to the transmitting, receiving the comparison value, wherein the comparison value defines a range of operating conditions for the temperature of the brake rotor of the vehicle specific to the current location of the vehicle.

10. The computer program product of claim 1, wherein:

the determining the value of the operating condition comprises determining a temperature of a wheel bearing of the vehicle; and the obtaining the comparison value for the operating condition comprises: transmitting a current location of the vehicle to the database via the network; and in response to the transmitting, receiving the comparison value, wherein the comparison value defines a range of operating conditions for the temperature of the wheel bearing of the vehicle specific to the current location of the vehicle.

11. The computer program product of claim 1, wherein:

the determining the value of the operating condition comprises determining a travel distance of a strut of the vehicle; and the obtaining the comparison value for the operating condition comprises: transmitting a current location of the vehicle to the database via the network; and in response to the transmitting, receiving the comparison value, wherein the comparison value defines a range of operating conditions for the travel distance of the strut of the vehicle specific to the current location of the vehicle.

12. The computer program product of claim 1, wherein:

the determining the value of the operating condition comprises determining a temperature of a cylinder of the vehicle; and the obtaining the comparison value for the operating condition comprises: transmitting a current location of the vehicle to the database via the network; and in response to the transmitting, receiving the comparison value, wherein the comparison value defines a range of operating conditions for the temperature of the cylinder of the vehicle specific to the current location of the vehicle.

13. The computer program product of claim 1, wherein the computer device is integrated in the vehicle.

14. A method, comprising:

determine, by a computer device in a vehicle and based on data from a sensor on the vehicle, a value of an operating condition of a component of the vehicle;

obtain, by the computer device and via network communication from a database external to the vehicle, a comparison value for the operating condition of the component;

determine, by the computer device, the determined value based on the data from the first sensor deviates from the comparison value by more than a threshold amount; and generate, by the computer device an alert in the vehicle based on the determining the determined value deviates from the comparison value by more than the threshold amount.

15. A system, comprising:

a vehicle comprising an on-board computer device that is configured to:

determine, based on data from a sensor on the vehicle, a value of an operating condition of a component of the vehicle;

obtain, via network communication from a database external to the vehicle, a comparison value for the operating condition of the component;

determine the determined value based on the data from the first sensor deviates from the comparison value by more than a threshold amount; and generate an alert in the vehicle based on the determining the determined value deviates from the comparison value by more than the threshold amount.

* * * * *